US009725964B2

(12) United States Patent
Millet et al.

(10) Patent No.: US 9,725,964 B2
(45) Date of Patent: Aug. 8, 2017

(54) ELECTROMAGNETIC COUPLER

(75) Inventors: Francois Millet, Antony (FR); Yvan Boudey, Paris (FR); Stephane Thobois, Fontaine la Guyon (FR)

(73) Assignee: VALLOUREC DRILLING PRODUCTS FRANCE, Cosne-Cours-sur-Loire (FR)

( * ) Notice: Subject to any disclaimer, the term of this patent is extended or adjusted under 35 U.S.C. 154(b) by 483 days.

(21) Appl. No.: 14/234,785

(22) PCT Filed: Jul. 26, 2012

(86) PCT No.: PCT/EP2012/064743

§ 371 (c)(1),
(2), (4) Date: Mar. 11, 2014

(87) PCT Pub. No.: WO2013/014254

PCT Pub. Date: Jan. 31, 2013

(65) Prior Publication Data

US 2014/0174715 A1 Jun. 26, 2014

Related U.S. Application Data

(60) Provisional application No. 61/533,328, filed on Sep. 12, 2011, provisional application No. 61/533,331, filed on Sep. 12, 2011.

(30) Foreign Application Priority Data

Jul. 27, 2011 (FR) ..... 11 02348
Jul. 27, 2011 (FR) ..... 11 02349

(51) Int. Cl.
*E21B 17/02* (2006.01)
*E21B 17/00* (2006.01)

(52) U.S. Cl.
CPC ..... *E21B 17/028* (2013.01); *E21B 17/003* (2013.01)

(58) Field of Classification Search
CPC ..... E21B 17/028; E21B 47/12; E21B 17/003
See application file for complete search history.

(56) References Cited

U.S. PATENT DOCUMENTS 3,784,959 A 1/1974 Horton
2002/0193004 A1* 12/2002 Boyle ..... E21B 17/028 439/577

(Continued)

FOREIGN PATENT DOCUMENTS

FR 2 951 119 A1 4/2011
FR 2 952 119 5/2011
WO 2004/067901 A1 8/2004

OTHER PUBLICATIONS

International Search Report issued Nov. 23, 2012, in PCT/EP2012/064743, filed Jul. 26, 2012.

*Primary Examiner* — David Andrews
(74) *Attorney, Agent, or Firm* — Oblon, McClelland, Maier & Neustadt, L.L.P.

(57) ABSTRACT

A tubular component for oil exploration includes an electromagnetic half-coupler that can be coupled to a half-coupler of another tubular component to allow data transmission, wherein an end portion of the tubular component includes a housing accommodating the half-coupler, the half-coupler including a coupling element and an annular armature for the coupling element, the coupling element including an annular body formed from a material with a high magnetic permeability and an electrical conductor having turns, the armature including a first portion and a second portion configured to accommodate the coupling (Continued)

Figure 1:
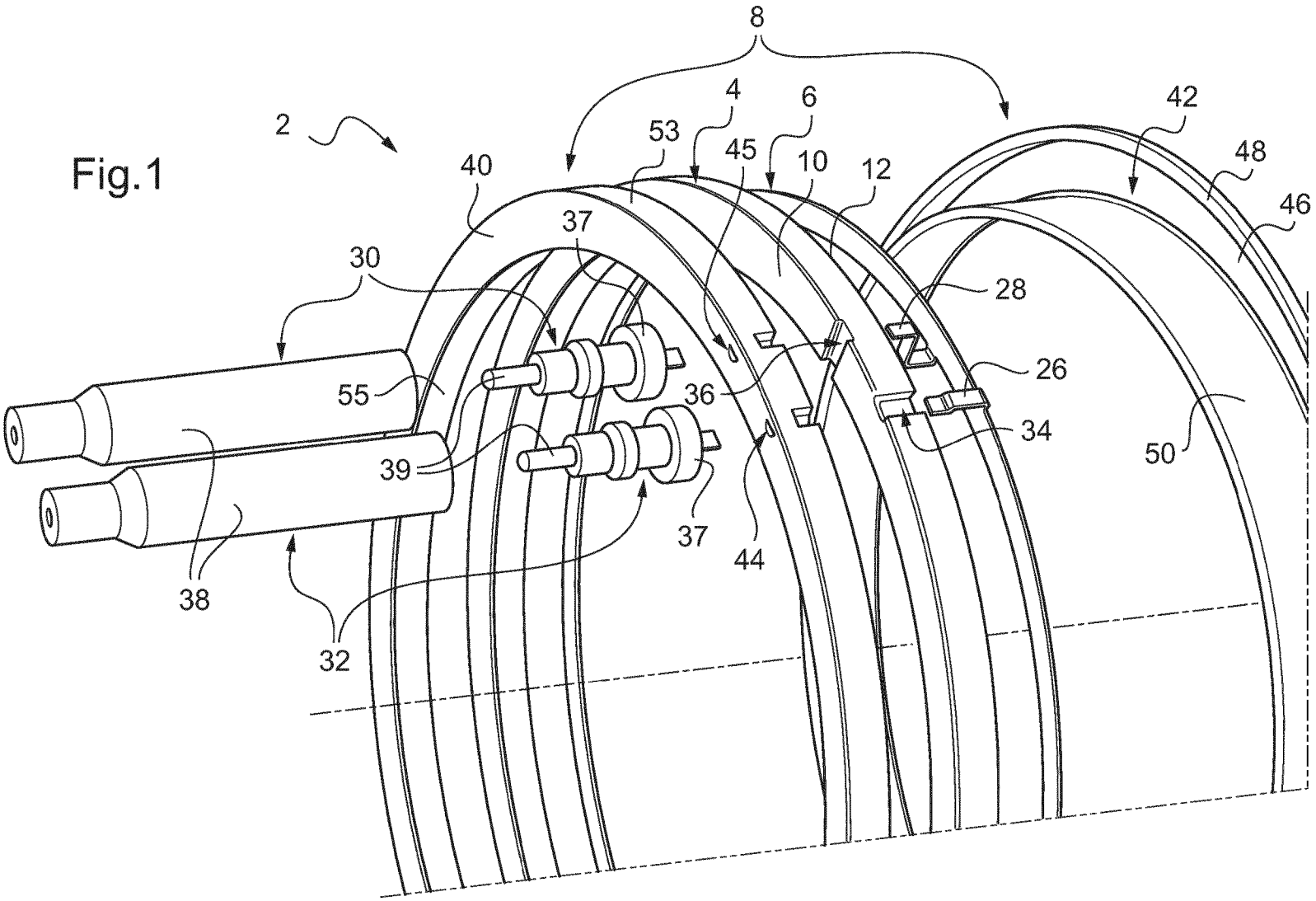

element, the armature being partially surrounded by an isolating and impervious material to protect the half-coupler against infiltration.

18 Claims, 8 Drawing Sheets

(56) References Cited

U.S. PATENT DOCUMENTS

| | | | | |
|---|---|---|---|---|
| 2004/0149471 | A1 | 8/2004 | Hall et al. | |
| 2004/0150532 | A1 | 8/2004 | Hall et al. | |
| 2004/0164838 | A1* | 8/2004 | Hall | E21B 17/028 336/234 |
| 2005/0145406 | A1 | 7/2005 | Hall et al. | |
| 2007/0018847 | A1 | 1/2007 | Hall et al. | |
| 2007/0056723 | A1 | 3/2007 | Hall et al. | |
| 2009/0151926 | A1* | 6/2009 | Hall | E21B 17/028 166/65.1 |
| 2011/0100703 | A1* | 5/2011 | Harmon | E21B 17/028 174/520 |
| 2014/0041945 | A1 | 2/2014 | Guelaz et al. | |

* cited by examiner

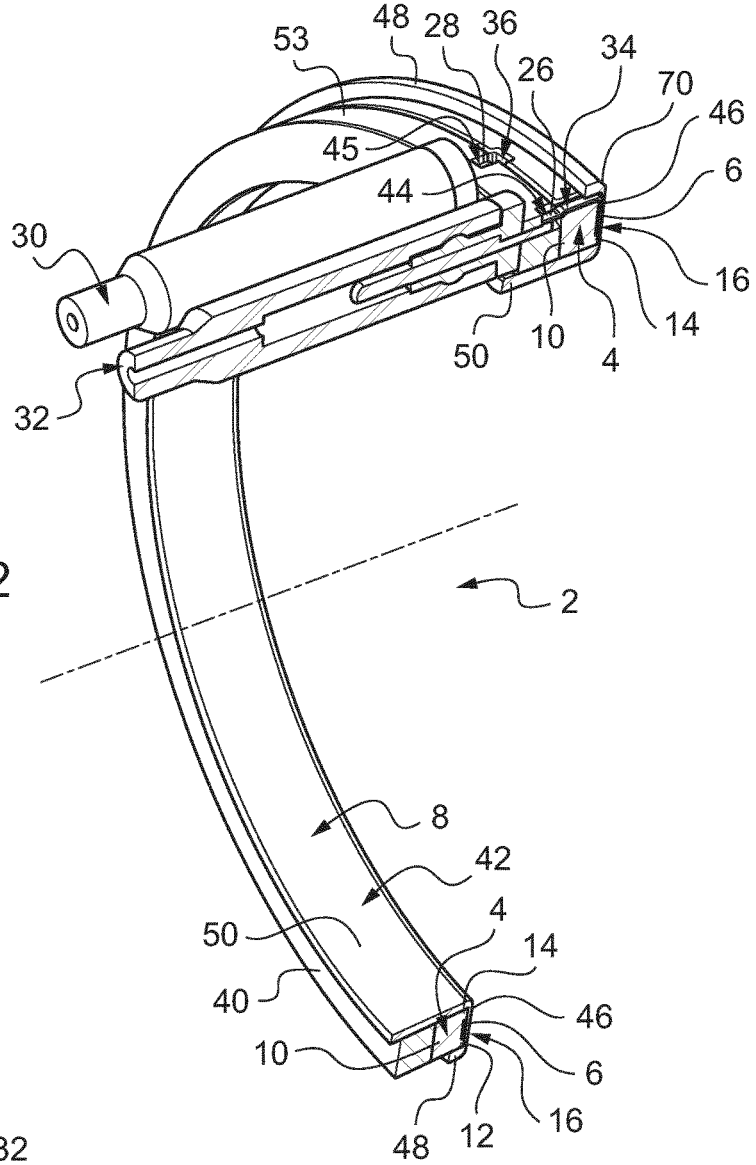
Fig.2
Fig.3
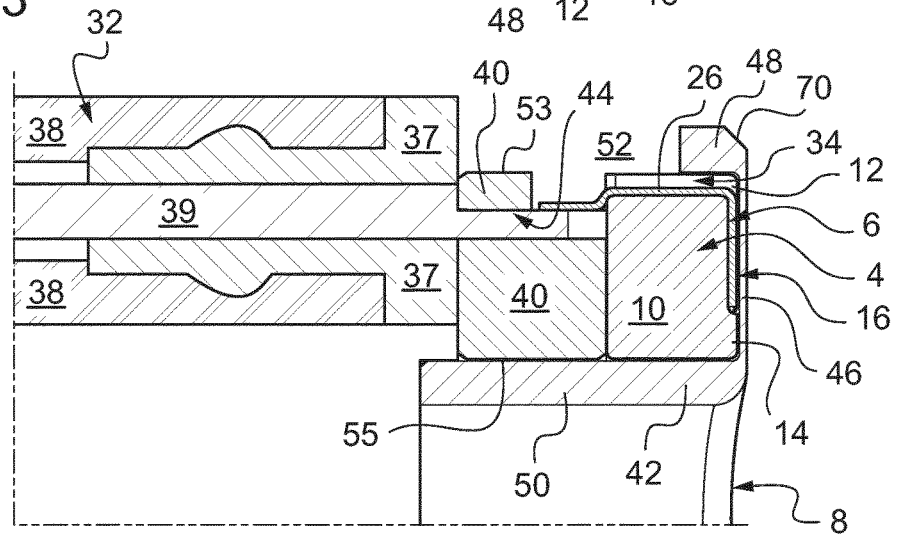

Fig.4
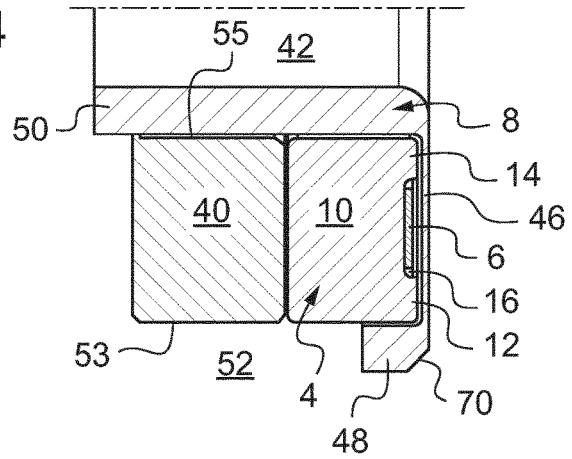
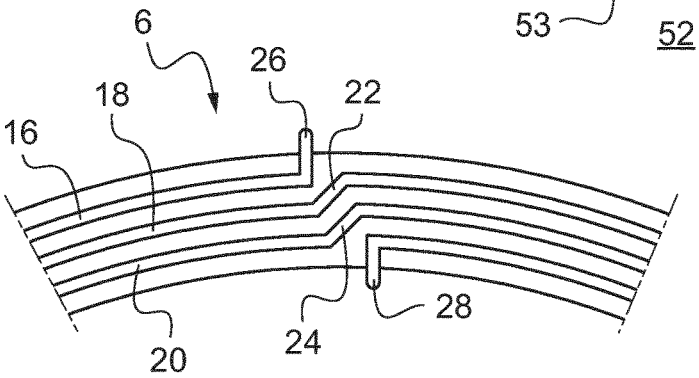
Fig.5
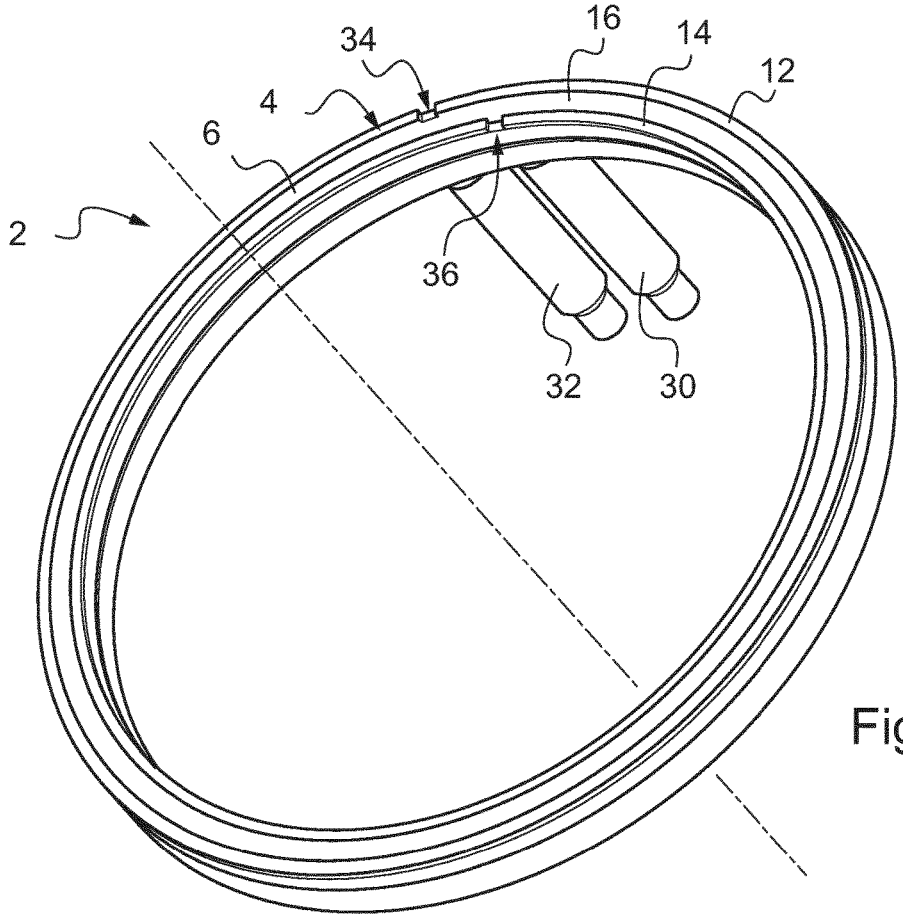
Fig.6

ELECTROMAGNETIC COUPLER

The invention relates to the field of electromagnetic coupling.

Certain cutting edge industrial fields such as oil exploration operate in environments that render data transmission complicated.

In French patent application FR 11/00523, the Applicant proposed a non-contact electromagnetic coupler. That coupler performs extremely well compared with all other known couplers for oil industry applications.

Prior art document U.S. Pat. No. 7,362,235 describes an inductive coupler disposed at a junction between two drilling tubes.

The tubes on which those couplers are mounted are subjected to substantial stresses. The couplers include a body formed from a very high magnetic permeability material. That type of material is generally fairly fragile and does not tolerate well the vibrations and shocks to which the tubes are likely to be subjected in a well bore.

Thus, there is a risk that the body of the coupler could break when in position in the well bore. Such a breakage is unacceptable, since it means that the coupler no longer functions and that the data transmission chain between the surface and the well bottom is interrupted.

The invention aims to improve the situation. To this end, the invention proposes an electromagnetic half-coupler of the type comprising a coupling element formed at least in part from a material with a high electromagnetic permeability, said coupling element having an annular body with an open cross section defining a housing for at least a portion of an electrical conductor having turns. Said half-coupler further comprises an annular armature receiving said annular body and arranged to hold it.

In particular, the invention concerns a tubular component for oil exploration, comprising an electromagnetic half-coupler which can be coupled to an electromagnetic half-coupler of another tubular component so as to allow data transmission, wherein an end portion of the tubular component comprises a housing accommodating said half-coupler, said half-coupler comprising a coupling element and an annular armature for the coupling element, the coupling element comprising an annular body formed at least in part from a material with a high magnetic permeability and an electrical conductor having turns, characterized in that the armature comprises a first portion and a second portion which are arranged to accommodate said coupling element, the armature being at least partially surrounded by an isolating and impervious material in order to protect the half-coupler against infiltration, especially the infiltration of drilling mud, in particular the infiltration of salt water.

The isolating material forms a connection between the first portion and the second portion. The association of the first portion with the second portion can define an unsealed housing, or it may even exhibit openings. The isolating material can close the openings. The isolating material makes the housing defined by the armature impervious to drilling mud and/or salt water.

In particular, the material may be selected from the group comprising a hydrogenated rubber enriched with nitrile and butadiene (HNBR), a polytetrafluoroethylene (PTFE), a polyether-etherketone (PEEK), an ethylene-propylene-diene monomer, a fluoroelastomer, a fluorosilicone and a perfluoroalkoxy compound.

Said material may have the elastic and/or damping properties of a spring, in order to provide cushioning. Thus, when the half-coupler is appropriately positioned in the tube, the isolating material can mechanically isolate at least a portion of the half-coupler from the tube. By means of the spring-damper, in other words cushioning, vibrations and relative displacements of the tube and of the half-coupler can be at least partially absorbed by the spring during assembly and in operation.

The half-coupler and the spring may be readily accessible in the bore of the tube to allow for relatively simple replacement during maintenance.

In particular, the insulating material may define a surface substantially facing the bore of the end portion of the tubular component, said surface having annular beads which define a space intended to be at least partially free after assembling the component with another component.

In particular, the component of the invention may comprise an annular liner accommodated in the bore of the end portion of the tubular component comprising said housing, wherein said housing is defined by an axial abutment surface of said liner.

The invention also concerns a threaded tubular connection comprising a first tubular component and a second tubular component, each component corresponding to the invention described above, wherein the first tubular component and the second tubular component are mutually assembled by making up their end portions such that the half-coupler of the first tubular component and the half-coupler of the second tubular component are capable of being mutually coupled in operation, an annular space being located axially between the materials of the first tubular component and of the second tubular component after completing makeup. Thus, when two half-couplers are caused to face each other in a suitable manner, the respective conductors face each other. By means of the armature, if one or even both of the two annular bodies break under shock or stress, they are held in place, housed in the armature. Since continuity of the annular body is not necessary to obtain the desired electromagnetic effect, the electromagnetic coupler remains functional.

Figure 7:
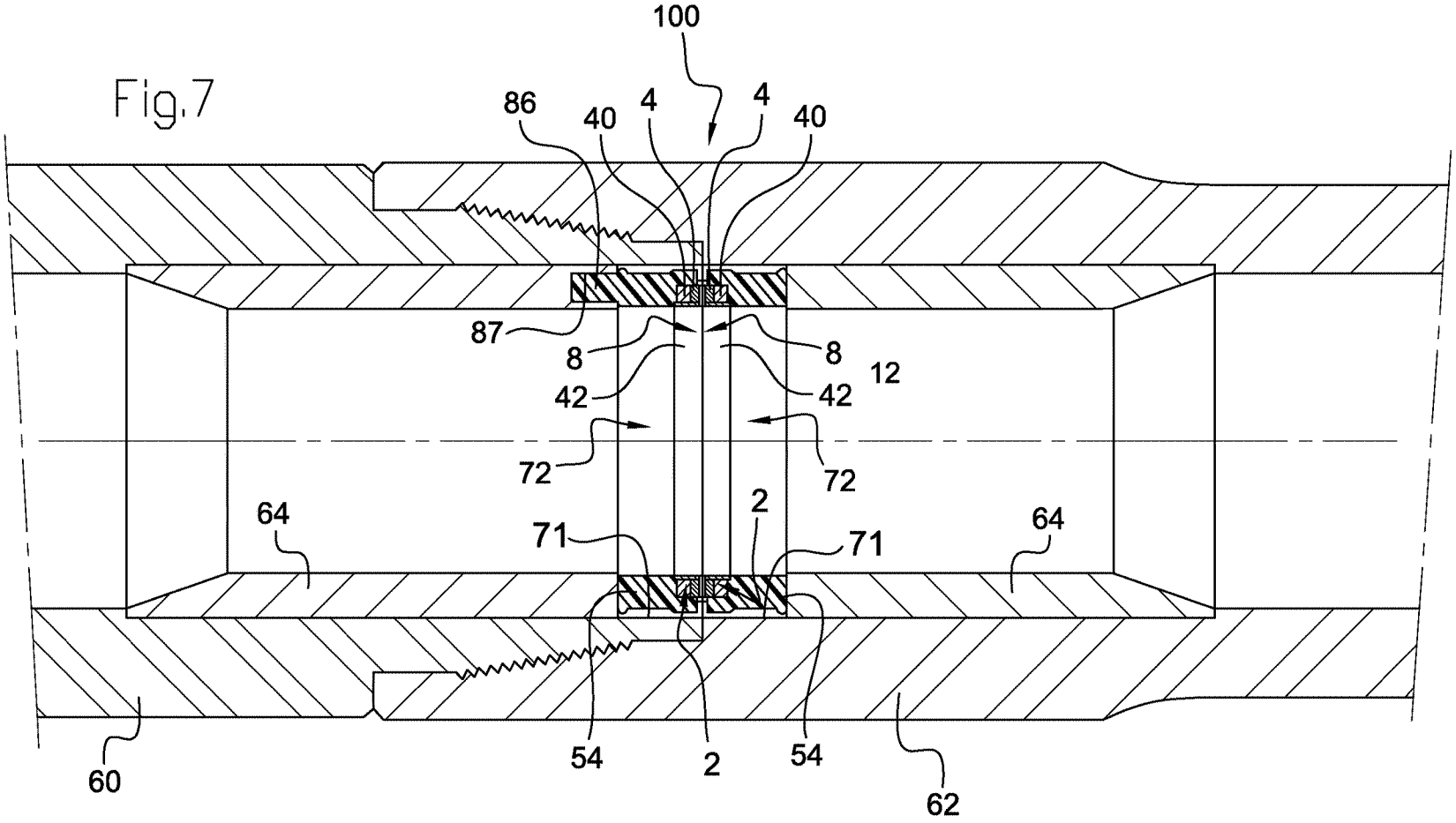
Figure 8:
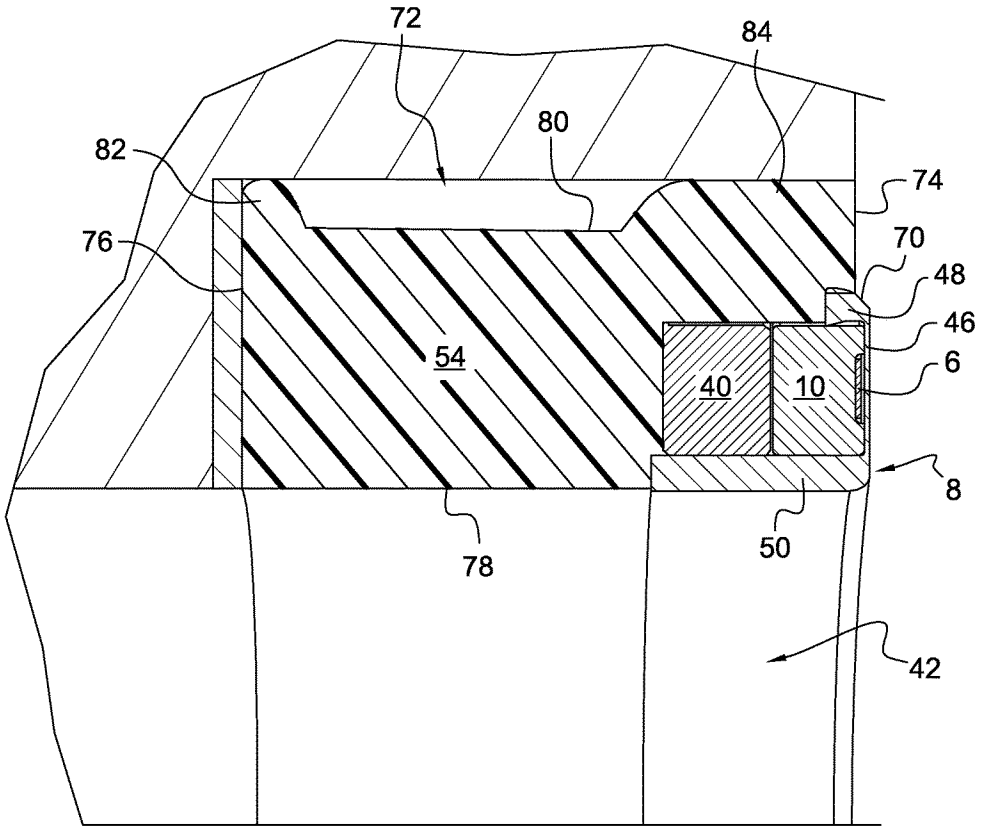
Figure 9:
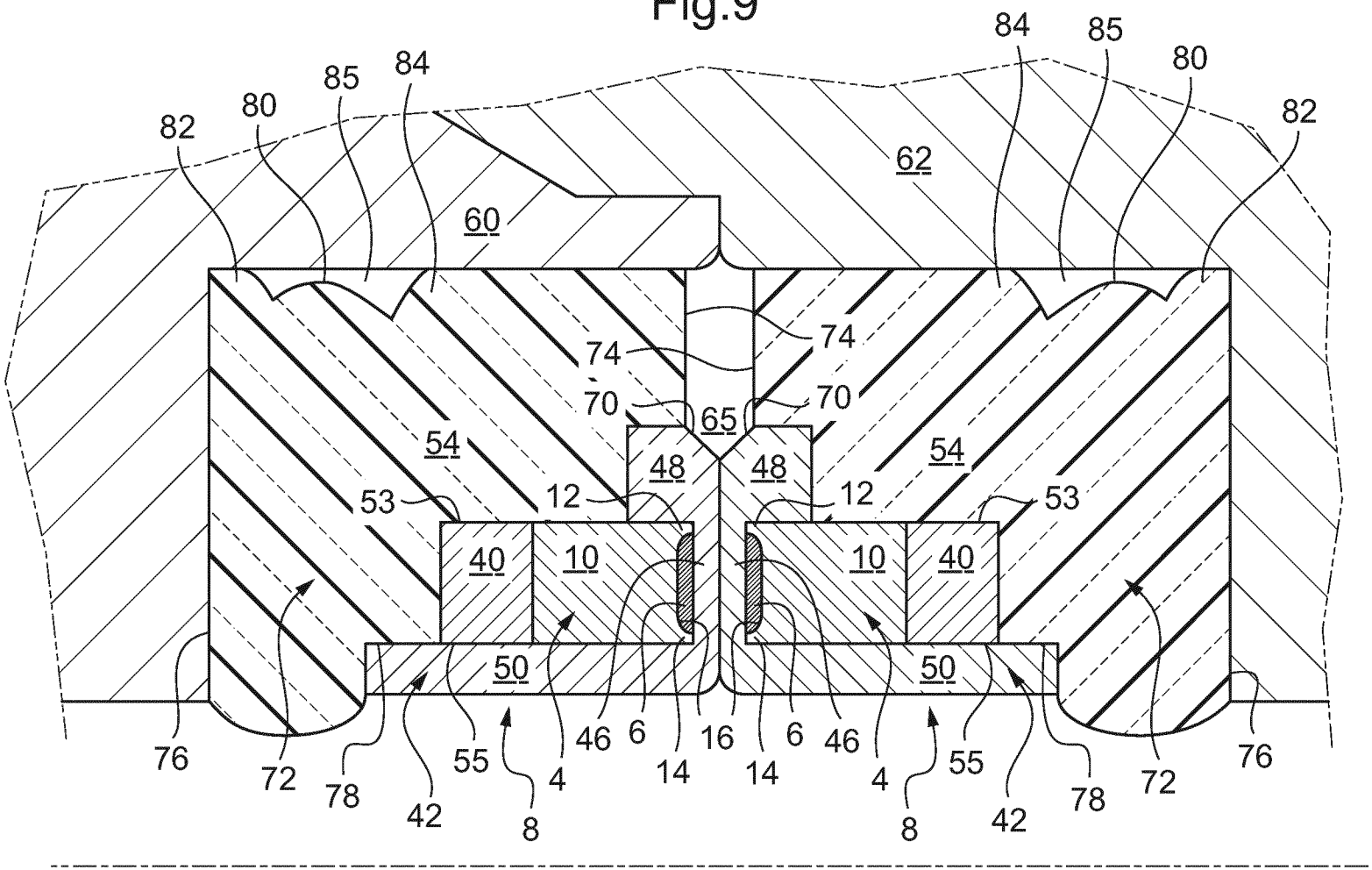
Figure 10:
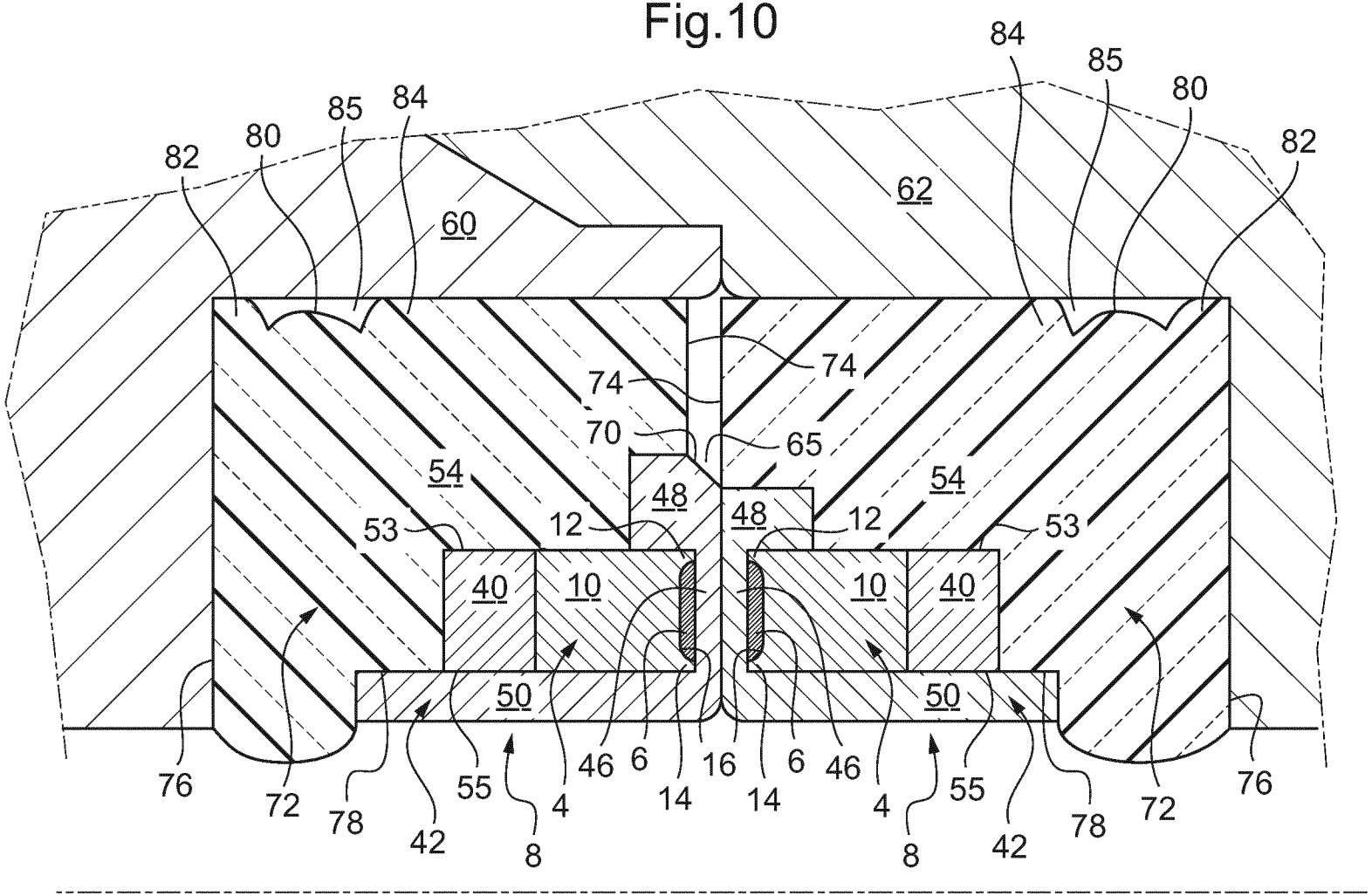
Figure 11:
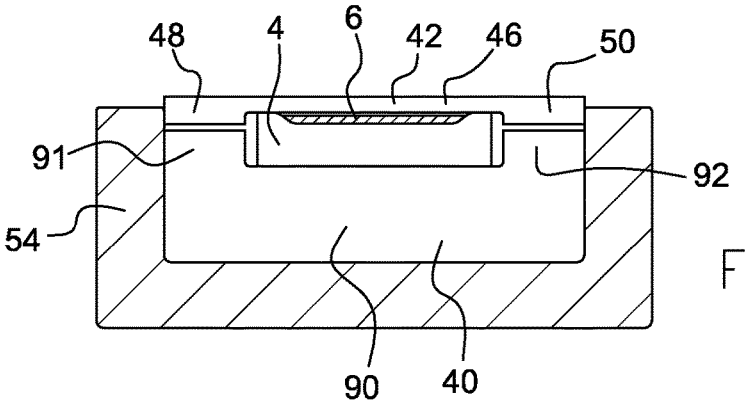
Figure 12:
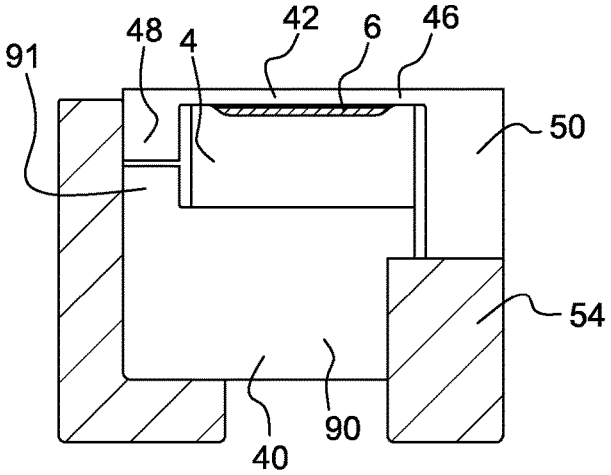
Figure 13:
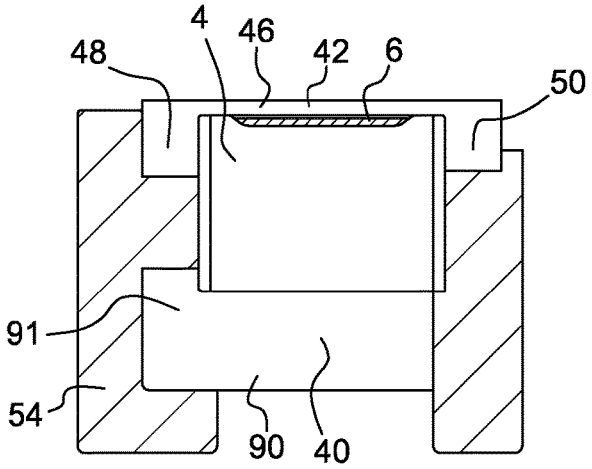

Other characteristics and advantages of the invention will become apparent from the following description drawn from examples given by way of non-limiting example and made with reference to the accompanying drawings in which:

- FIG. 1 shows an exploded three-quarters rear perspective view of an electromagnetic half-coupler of the invention; the spring thereof has not been shown;
- FIG. 2 shows a three-quarters rear perspective sectional view of the half-coupler of FIG. 1;
- FIG. 3 shows an enlarged view of a portion of FIG. 2;
- FIG. 4 shows an enlarged view of a portion of FIG. 2;
- FIG. 5 shows an enlarged view of an element of FIG. 2;
- FIG. 6 shows a view similar to that of FIG. 1 but not exploded, from a different angle and with one element removed;
- FIG. 7 shows a view of a variation of a pair of half-couplers in the installed and coupled position;
- FIG. 8 is an enlarged sectional view of a coupler and a spring;
- FIG. 9 is a detailed view of FIG. 7; and
- FIG. 10 is a view similar to that of FIG. 9 of a variation;
- FIGS. 11 to 13 are views of variations of an isolated armature for a half-coupler in accordance with the invention The drawings and the description below essentially contain elements of a concrete nature. However, they not only serve to provide a better understanding of the present invention, but also contribute to its definition if necessary.

FIG. 1 shows an exploded three-quarters rear perspective view of an electromagnetic half-coupler 2 of the invention. In order to form a complete electromagnetic coupler, an identical electromagnetic half-coupler is disposed facing this half-coupler.

The half-coupler 2 is generally annular in shape and comprises a body 4, a conductor 6 and an armature 8. The body 4 and the conductor 6 form an electromagnetic coupling element.

As can be seen in FIG. 2, the body 4 is generally annular in shape with a cross section in the form of a square bracket or "[". This section comprises a base 10 and two limbs 12 and 14. The base 10 and the limbs 12 and 14 define a housing 16 between them.

The base 10 is very thick in comparison with the extra thickness of the limbs 12 and 14. In the example described here, the base 10 is in the range 2 to 8 mm thick, for example approximately 3.25 mm thick, while the limbs 12 and 14 have an extra thickness in the range 0.1 to 1 mm, for example 0.3 mm, with respect to the base 10. The extra thickness of the limbs 12 and 14 with respect to the base 10 defines the depth of the housing 16. This extra thickness may in general be between 0.1 mm and 1 mm.

In the example described here, the body 4 is formed from a ceramic comprising Fe, Mn and Zn. This material is also known as "soft ferrite" and its generic formula is $Mn_xZn_yFe_{2+z}O_4$, where x+y+z=1.

In the example described here, this material has a relative magnetic permeability $\mu_r$:

of 2050 at 10 kHz and at a temperature of 22° C.;
of 2600 at 1 MHz and at a temperature of 22° C.;
of 1200 at 2 MHz and at a temperature of 22° C.;
of 350 at 3 MHz and at a temperature of 22° C.;
of up to 5000 between 100 kHz and 1 MHz in the thermal range 100° C. to 220° C.

In this embodiment, the ferrite has a spinel structure and has a resistivity in the range 200 to 1600 ohm.cm for frequencies in the range 10 kHz to 1 MHz at a temperature of 22° C. In a variation, the body 4 could be produced from another type of ferrite or from another solid material with a relative magnetic permeability of more than 100 in the 1 kHz to 1 MHz range and having a negligible or zero electrical conductivity. A material with a high magnetic permeability is a material with a permeability of more than 100 in the 1 kHz to 1 MHz range, or even in the 1 kHz to 10 MHz range.

The conductor 6 in the example described here is a printed circuit with an annular shape. In a variation, the conductor 6 could be produced with copper windings, or from any other appropriate material that can produce an electrical conductor having turns. In a variation, the material forming the windings may be silvered.

As can be seen in FIG. 5, the conductor 6 comprises three concentric conductive turns with reference numerals 16, 18 and 20. Offsetting portions 22 and 24 make the turns 16 to 20 electrically continuous. In a variation, the conductor 6 may comprise more than three turns.

Facing the offsetting portions 22 and 24, the conductor 6 further comprises two connection or terminal portions with reference numerals 26 and 28. As can be seen more clearly in FIG. 2, the terminal portions 26 and 28 extend substantially perpendicular to the plane of the conductive tracks 16, 18 and 20 and terminate in conductors 30 and 32 for electrical connection to cable(s) carrying the signal. In order to house the portions 26 and 28, the body 4 formed from ferrite comprises two respective recesses 34 and 36 which are visible in FIG. 6. The recess 34 is provided both locally in the limb 12 and in the outer surface of the body 4, while the recess 36 is provided both locally in the limb 14 and in the inner surface of the body 4.

In the embodiment described here, the connectors 30 and 32 are produced in the form of polyether ether ketone (PEEK) connectors. The connectors 30 and 32 are disposed substantially parallel to each other and extend in a direction substantially parallel to the axis of revolution of the coupler. As can be seen more clearly for the connector 32 in FIG. 3, each connector 30 and 32 comprises a male portion 37 and a female portion 38. The female portion 38 is snap fitted around the male portion 37 so as to form a female socket for a tip of a transmission cable intended to extend from one end of a tubular component to the other. The male portion 37 receives a conductor 39 which transmits signals between the half-coupler 2 and the cable received in the female portion 38.

In a variation, the connectors 30 and 32 could be formed in distinct regions of the half-coupler and extend in different directions. In other variations, the connectors 30 and 32 could be combined into a single coaxial type connector. Finally, the conductor 39 could be omitted, with the cable being directly connected to the terminal portions 26 and 28 through the male portion 37.

The armature 8 comprises a first portion 40 and a second portion 42. The first portion 40 and the second portion 42 are arranged to house the body 4, for example in a non-removable manner. In the example described here, the first portion 40 is an annular ring having a substantially rectangular cross section on which the body 4 bears. The height of the first portion 40 is substantially equal to the height of the body 4, for example approximately 5 mm, and the width is approximately 4 mm, for example. In a variation, the height of the first portion 40 may be substantially greater or lesser than that of the body 4, but the support function of the first portion 40 will be retained.

In variations shown in the diagrams of FIGS. 11 to 13, in addition to a base 90, the first portion 40 may comprise at least one limb 91, or even two limbs 91 and 92 respectively, raised from its base 90. In the example of FIG. 11, the limbs 91 and 92 respectively have the same height relative to the base 90, but they may be different. In FIGS. 12 and 13, the first portion 40 comprises a base 90 and a single limb 91, perpendicular to the base 90 and directed along the longitudinal axis of the tube into which the half-coupler will be inserted. In particular, this limb 91 is raised over the radially outer edge of the base 90.

The first portion 40 comprises two axial through recesses 44 and 45 substantially at the connection between the terminal portion 26 of the conductor 6 and the conductor 39 of the connector 32 on the one hand and at the connection between the terminal portion 28 of the conductor 6 and the conductor 39 of the connector 30 on the other hand. The recess 44 is arranged to accommodate the terminal portion 26 of the conductor 6 and the portion 39 of the connector 32, and the recess 45 is arranged to accommodate the terminal portion 28 of the connector 6 and the portion 39 of the connector 30. The portion 26, or respectively 28, may thus be placed in electrical contact with the portion 39 of the connector 32 or respectively 30 at the recess 44 or respectively 45.

In the example described here, the recess 44 is a notch which opens in part radially onto an outer surface 53 of the half-coupler 2. The recess 45 is a notch which opens in part radially onto the outer surface 53 of the half-coupler 2. Part of the recesses 44 and 45 open onto at least the outer surface 53 in order to facilitate access when welding electrical contact elements between the conductor 6 and the connectors 30 and 32 when installing and to provide some space for surplus material on welding.

The dimensions of the first portion 40 are such as to produce a satisfactory stiffness and provide sufficient space for the recesses 44 and 45.

In the example described here, the second portion 42 of the armature 8, visible in FIGS. 1 to 3, has an annular shape and has a substantially "J" shaped cross section, or a "U" shaped cross section with limbs of unequal lengths. Thus, the second portion 42 comprises a base 46 and limbs 48 and 50 of different lengths. The second portion 42, in particular the base 46, is disposed substantially facing the conductor 6.

The base 46 is very thin, of the order of 200 μm in the example described here. The thickness of the base 46 may be in the range 25 μm to 300 μm. It is thin so that when two half-couplers are placed in contact facing each other, their electrical conductors are close to each other. Otherwise, the electromagnetic losses could become excessive.

The limb 48 will cover the limb 12 of the body 4 and block it radially over an appropriate length, for example a distance of approximately 1.2 mm. Since the body 4 and the first portion 40 are almost identical in height, the free portion of the limb 12 and the upper portion of the first portion 40 define a free annular space 52 with the limb 48. This annular space may be used to inject a material 54, and to link the first portion 40 and the second portion 42 together. The body 4 is retained in the housing formed by the first portion 40 and the second portion 42. The material 54 may also directly connect the body 4 to the first portion 40 and to the second portion 42. The material 54 contributes to isolating and closing off the housing defined for the coupling element.

This material 54 may also be used as a spring element, as will be described with reference to FIGS. 7 and 8.

The limb 50 covers the limb 14 of the body 4 and extends to cover an inner surface 55 of the first portion 40 (at the bottom in FIG. 3, at the top in FIG. 4) and extend beyond it axially, for example by approximately 1 mm.

The extra length of the limbs 48 and 50 and their respective thicknesses mean that the seal obtained by adhesion of the material 54 can be optimized; the substance will be described below. In order to guarantee an effective junction between the material 54 and respectively the first portion 40 and the second portion 42, the material 54 must be in contact over a distance of at least 1.5 mm, more preferably by at least 2 mm.

In a variation, as can be seen in FIG. 11, the height and thickness of each of the limbs 48 and 50 are identical. These limbs 48 and 50 have a thickness similar to that of the limbs 91 and 92 which they face when in position. The material 54 does not insinuate itself into the plane of the joint between the facing faces of the limbs 91 and 92 and 48 and 50 respectively. On the contrary, the material 54 will become adhered over a sufficient height over each of these limbs for them to stick together and isolate the plane of the joint.

In the variation of FIG. 12, the plane of the joint of the front faces of the limbs 48 and 91 that face each other is substantially transverse to the axis of the tube, while the limb 50 extends along a portion of the base 90 such that the plane of the joint between the limb 50 and the base 90 is substantially longitudinal to the axis of the tube. In this embodiment, the base 90 has at least two distinct thicknesses determined transverse to the axis in order to provide a sufficient radial length for adhesion for the material 54 in the continuity of the limb 50.

In another variation, shown in FIG. 13, the first portion 40 and the second portion 42 define an open housing for the coupling element in the absence of the material 54. In effect, in this variation, the material 54 comes between the facing faces of the limbs 91 and 48. The material 54 will also come between the limb 50 and the base 90, since the limb 50 is not disposed close to the base 90. In this variation, the material 54 may also be caused to adhere to the body 4.

The material 54 may also be brought around the connectors 30 and 32 in order to provide a seal for the junction between these connectors 30 and 32 and the armature 8.

In the example described here, the armature 8 is produced from zirconia, or zirconium oxide ($ZrO_2$). This material is particularly advantageous as it can be machined and has remarkable electrical insulation, stiffness (Young's modulus), bending and compressive strength, hardness and resilience characteristics.

As an example, in this embodiment, the zirconia may be in the form of a polycrystalline tetragonal zirconia ceramic comprising 3 mole % of yttrium (3Y-TZP). The zirconia for the first portion 40 may have a grain size of 0.5 μm and have a density of 6.05 g/cm$^3$, a Vickers hardness $Hv_{0.3}$ of 1300, a bending strength of approximately 1000 MPa at 20° C., as well as a resistivity of more than 2000 ohm.cm for temperatures below 400° C. An example of this type of zirconia is sold under the trade name TECHNOX® 2000. The zirconia for the second portion 42 may have similar characteristics but have a Vickers hardness $Hv_{0.3}$ of 1350 and a bending strength of approximately 1400 MPa at 20° C. An example of this type of zirconia is sold under the trade name TECHNOX® 3000. Other types of ceramic may be envisaged.

These characteristics are important since the electromagnetic coupler is likely to be placed in a zone that exposes it to heterogeneous mud under pressure. The hardness of the zirconia is such that it hardly undergoes any abrasion. Moreover, that abrasion will only be likely to cause a problem when the other components of the coupler have already failed.

In view of the foregoing, the armature 8, together with the material 54, thus form a sealed casing or "container" in which the body 4 receiving the conductor 6 is housed. Thus, even if the body 4 breaks under the effect of shock or stress, it substantially retains its general shape, and the conductor 6 remains in place, which ensures that the electromagnetic coupler continues to operate effectively. The conductor 6 is shown integral with the body 4; it may also be integral with an inner face of the armature 8.

FIG. 7 shows a coupler, in this case two mutually coupled together half-couplers 2, in accordance with the invention, in place in an oil well drill string.

This Figure shows the connection portion or threaded tubular connection 100 of two successive tubes or tubular components 60 and 62. The first tubular component 60 and the second tubular component 62 are mutually assembled by making up their respective end portions. The tubular components 60 and 62 each receive, at their respective ends, a liner 64 in a region close to the threading zone. The liner 64 has a number of advantageous applications, in particular to bring the cable carrying the electrical signal to the half-coupler 2. Examples of embodiments of the liner 64 have been described in more detail in French patent applications FR 11/00608 and FR 11/00609. Each of the tubular components 60 and 62 comprises a housing 71 to receive a spring 72. The housing 71 in this case is formed by the bore of an end portion of each of the tubular components 60 and 62 and is defined by an axial abutment surface supported by each of the respective liners 64. In other embodiments, the housing 71 is integrally formed by the bore of an end portion of each of the tubular components 60 and 62, and the liner 64 can be omitted.

In order to properly isolate the coupler mechanically from the outside, the material 54 is moulded around the armature 8. In the example described here, each half-coupler is nested in a mass of hydrogenated nitrile butadiene rubber (HNBR) material 54, leaving at least the base 46 and possibly in addition the limb 50 of the second portion 42 of the armature 8 free.

In general, each half-coupler is thus at least partially buried in the material 54. In other embodiments, each half-coupler may be received in the material 54 in a looser manner.

In a variation, the material 54 may comprise other materials, combined or otherwise, selected from polytetrafluoroethylene (PTFE), ethylene-propylene-diene monomers (EPDM), fluoroelastomers (FKM), fluorosilicones and perfluoroalkoxy compounds (PFA). These materials may contain various mineral and/or metallic materials, in order to improve their properties, in particular their mechanical properties. In a variation, the spring 72 may be produced in other shapes, such as in the shape of a coil spring, alveolate spring or any other type of spring. In particular, the material 54 may form the spring 72, in particular because of its damping property.

The material 54 is selected such that it has a Young's modulus which is much smaller than that of the materials selected to form the armature, in particular 50 times smaller, or even 100 times smaller.

Adhesion of HNBR to the first portion 40 of the armature 8, in particular in the annular space 52, means that the coupler can be protected against the infiltration of external liquids or mud. This is particularly important as regards the body 4, since the infiltration of salt water may have deleterious consequences in terms of altering signal transmission.

When the two tubular components 60 and 62 are made up and tightened together, the bases 46 of the respective armatures 8 of each half-coupler 2 come into contact with each other. In this case, any mud or other material which is caught between the surfaces is crushed and ground. This is the reason why the second portion 42 is formed from a harder zirconia with a higher bending strength than the first portion 40. This choice is also justified by the fact that the second portion 42 is thin at its base 46. It is, however, possible to use the same zirconia for the first portion 40 and the second portion 42.

The ground residues are then driven radially either inwards or outwards. In the first case, the residues are evacuated with the flow of mud which moves inside the tubular components 60 and 62. In the second case, the residues are trapped between the half-coupler 2 on the one hand and the bore of the tubular component accommodating the half-coupler 2 on the other hand. This is disadvantageous and risks placing the threaded connection 100 of the tubular components 60 and 62 under pressure, of damaging and/or weakening it, or even of disturbing the positioning of the two half-couplers with respect to each other.

Advantageously, the limb 48 of the second portion 42 of at least one of the half-couplers 2 has a chamfer 70. The chamfer 70 means that an annular space 65 can be maintained around the armature 8 once the tubular connection 100 has been coupled up. The space 65 can be used to accommodate residues without placing the threaded connection 100 under pressure.

As can be seen in FIGS. 7 and 8, the HNBR in which each half-coupler 2 is embedded is very important as it can be used to form a spring 72 acting as a buffer and having a shock absorbing function. HNBR has excellent abrasion resistance properties, as of course does zirconia. HNBR has elastic properties which mean that it can be used as a spring while offering excellent properties of abrasion resistance, as of course does zirconia.

The end portions of the tubular components 60 and 62 accommodate the springs 72 such that the half-couplers 2 of each of the tubular components 60 and 62 of the tubular connection 100 are mutually coupled at the end of makeup. The spring is disposed in the respective housing 71 of the tubular components 60 and 62.

In the example, the spring 72 has a generally annular shape. In cross section, as can be seen in FIG. 8, the spring 72 is axially defined on one side by a front annular surface 74. The front annular surface 74 extends substantially perpendicular to the axis of the tubular components 60 and 62. In this case, the front annular surface 74 is slightly set back in the axial direction with respect to the base 46 of the armature 8 of the half-coupler 2 towards the middle of the tubular component 60. This set back may, for example, be approximately 0.5 millimeter, preferably in the range 0.25 millimeter to 1 millimeter. The front annular surface 74 is then connected to the contact surface of the base 46 of the half-coupler 2 via the chamfer 70. The contact surface of the base 46 is substantially perpendicular to the axis of the tubular component 60.

In the embodiment corresponding to FIG. 8, upon makeup before completion, the two half-couplers 2 are in mutual contact via their respective bases 46. The two front annular surfaces 74 of the springs 72 are mutually separated. After completing the connection, and as can be seen in FIGS. 9 and 10, the two front annular surfaces 74 of the springs 72 are still apart, while the bases 46 are in interfering contact. The annular space created between the two chamfers 70 and the end portions of the springs 72 supporting the front annular surfaces 74 allow mud, impurities or debris to be evacuated without compromising the connection. This space leaves a passage for fluid after makeup of the tubular component 60 with another tubular component 62.

The embodiment of FIG. 9 shows a tubular connection 100 in which the shape of each of the springs 72 is substantially symmetrical and the limb 48 of each second portion 42 comprises a chamfer 70. In this embodiment, the threaded tubular connection 100 has an annular space located axially between the chamfers 70 of each of the half-couplers 2 of the tubular components 60 and 62 after completing the connection.

In a variation, shown in FIG. 10, one of the two half-couplers 2 has no chamfer 70. The front annular surface 74 and the base 46 of the armature 8 of this half-coupler are thus substantially aligned.

Opposite the front annular surface 74, the spring 72 is defined axially by a rear annular surface 76. The rear annular surface 76 is arranged so as to match the shape of the abutment surface of the housing 71 of the tubular component 60 in which the half-coupler 2 is to be installed. The rear annular surface 76 is located at an axial distance from the half-coupler 2. This distance is sufficient for the axial dimension of the spring 72 to be able to absorb shocks, vibrations and/or stresses on installation and operation, including thermal expansion, by elastic deformation, in this case approximately 20 mm.

In cross section, the spring 72 is defined radially on one side by an inner cylindrical surface 78. The inner cylindrical surface 78 is substantially aligned with the inner surface of the limb 50 of the armature 8. The smooth shape of the inner cylindrical surface 78 and the material which constitutes it are selected to facilitate passage of the stream in the tubular components 60 and 62 while being resistant to abrasion. On the other side, opposite to the inner cylindrical surface 78, the spring 72 is defined radially by an outer cylindrical surface 80. The outer cylindrical surface 80 is arranged so that it faces the bore portion of the tubular component 60 in which the half-coupler 2 is to be installed.

The surface connecting the front annular surface 74 and the inner cylindrical surface 78 matches the shape of the half-coupler 2 it envelops. The spring 72 may be overmoulded onto the armature 8 and the body 4 of the half-coupler 2. The spring 72 then finishes closing off the casing, of the "container", formed by the armature 8 around the body 4. The spring then fills the annular space 52.

The spring 72 comprises a rear annular bead 82 and a front annular bead 84 projecting from the outer cylindrical surface 80. When installed, these beads are intended to come into contact with the bore portion of the tubular component 60. These beads define an annular space 85 between them. This annular space 85 allows the substance constituting the spring 72 to expand radially when it undergoes axial compression. The radial expansion of the portion of the spring 72 in the annular space 85 following axial compression is thus free insofar as this portion of the spring 72 is only likely to come into contact with the bore of the tubular component 60 at the end of makeup. The dimensions of the beads 82 and 84 are such that the axial alignment of the half-coupler 2 is not affected by the makeup operation.

When installed, radial expansion of the spring 72 also takes place at the inner cylindrical surface 78. In the embodiment shown in FIG. 8, at rest, and 9, at the end of makeup, a portion of this inner cylindrical surface 78 extends inside the tube in which the mud moves. This portion is represented as being straight in cross section along the axis of the tube. In a variation, this portion could also be concave. When the portion is straight, it tends to take on a convex shape under the effect of compression. In contrast, when the curvature is concave, the curvature reduces or even is reversed so that it becomes convex because of radial expansion. This portion may protrude radially inwardly of the tube relative to the face of the limb 50 turned towards the interior of the tube. Preferably, a shape is selected which remains as straight as possible when compressed.

When installed, as shown in FIG. 7, an outer surface of the base 46 of the half-coupler 2 may be substantially aligned with the axial end of the bore portion of the tubular component 60 which receives it. When installed, the rear annular surface 76 is in contact with an axial abutment surface of the tubular component 60.

In a variation, the rear annular surface 76 may be reinforced by a ring adapted to resist contact with the tubular component. This ring may, for example, be formed from a less elastic material than the remainder of the spring 72, in order to guarantee a fit with the tubular component 60 without turbulence. In a variation, the rear annular surface 76 may be reinforced by a back ring, shown in FIG. 9, which is adapted to guarantee a turbulence-free connection with the tubular component 60. This ring has to be produced from a material which is less elastic than the remainder of the spring 72, for example from a material which is similar to that of the tubular component in which it is retained. This ring may be produced from high grade steel, for example a grade of the order of 165 ksi.

The half-coupler 2 comprises rotational indexing means intended to cooperate with complementary means of a tubular component 60 or 62. Here, the angular indexing means comprise a dog 86 or a claw projecting from the rear annular surface 76. Once installed, the dog 86 will project into a corresponding recess 87 provided in the axial abutment surface of the tubular component 60. The axial abutment surface and the recess 87 may be supported by the liner 64, as can be seen in FIG. 7.

In a variation, the half-coupler 2 may comprise several dogs 86 distributed over the circumference of the half-coupler 2, corresponding recesses 87 being provided in the axial abutment surface of the tubular component 60. In yet more variations, the indexing means may take other shapes, such as dogs provided on the axial abutment surface of the tubular component 60 and corresponding recesses in the rear annular surface 76.

When installed, the half-coupler 2 and the spring 72 are radially aligned on the inside with the internal diameter of the bore of the tubular component 60, and on the outside they bear on a suitable end portion of the bore of the tubular component 60.

The spring 72 in this case comprises two axial through holes dimensioned as a function of the connectors 30 and 32 and/or the connection cable(s). In a variation, the spring may comprise a single hole or more than two.

The spring 72 can be used to position the coupler as close as possible to the stream while guaranteeing its function. Because of the spring 72, the majority of the forces and stresses on installation and operation are absorbed, and are not transmitted to the armature 8. This reduces the risk of rupture of the body 4. If the body 4 does in fact break, the armature 8 will ensure that it retains its shape, guaranteeing its operation.

Thus, this assembly means that the half-coupler is a replaceable part which is readily accessible and can be extracted from its position in contact with the stream and thus can be readily changed in the event of a problem. This provides a great advantage over all other known couplers. Further, the fact that the coupler is placed in contact with the stream means that the design of the tubular component can be simplified since it is no longer necessary to machine a housing in the walls of the tubular components in order to protect the half-couplers from the stream; an internal groove or enlargement, located axially in the bore of the tubular component, is sufficient. Finally, this housing zone has little effect on the mechanical properties of the tubular connection, compared with a housing located closer to the threadings or provided from a substantially radial bearing or abutment surface of the walls of the tubular components.

The assembly of FIGS. 7 and 8 and in particular the interposition of a spring 72 between a tubular component 60 and its half-coupler 2 is not only compatible with electromagnetic couplers; it is in fact compatible with direct contact, toroidal or capacitive couplers; and so the spring 72 provides yet another major advantage.

In a variation, the half-couplers may bear at least in part on the tubular parts, for example liners, set into the bores of the tubular components, so as to further reduce machining and structural alteration of the end zones of the tubular components.

Advantageously, the half-couplers 2 may be provided with a radio frequency identification chip (RFID). Placing these markers in the half-couplers 2 rather than on the tubular components 60 themselves, for example, has the advantage of being readily accessible when reading the data during maintenance, such as during the course of drilling by means of a wire line, of being properly protected from the environment outside the tubular components and of being easily replaceable when changing the half-couplers during maintenance. The RFID chips facilitate digital tracking of the various components of a drill string.

In the example described here, the armature 8 has been described as having a first portion with a rectangular section and a second portion with a J-shaped section. However, it is possible to produce the armature 8 differently. As an example, the first portion could be produced with a U-shaped section which partially houses the body 4, and the second portion with a flat or completely flat U-shaped section which will close the first portion in the manner of a lid and cover the portion of the body 4 which is not housed in the first portion 40.

An armature 8 has been described here which comprises a first portion 40 with a substantially rectangular cross section and a second portion 42 with a substantially "J"-shaped cross section. Other sections may be envisaged; some non-limiting examples will now be given: each of the two portions, or both, may have a "U"-shaped cross section with limbs that may or may not be equal in length, mutually arranged to envelop at least a portion of the body 4. One of the two portions, or both, may have an "L"-shaped cross section with arms that may or may not be equal in length, mutually arranged to envelop at least a portion of the body 4. In a variation, the armature 8 may completely enclose the body 4. The spring 72 in this case acts as the sealed container of the armature 8 for the body 4. The armature 8 may also comprise more than two complementarily arranged portions. The armature 8 may be a combination of these variations.

In summary, the invention concerns an electromagnetic half-coupler of the type comprising a coupling element formed at least in part from a material with a high magnetic permeability, said coupling element having an annular body with an open cross section defining a housing for at least a portion of an electrical conductor 6 having turns, characterized in that it further comprises an annular armature receiving said annular body and arranged to maintain it.

This half-coupler may have one or more of the following supplemental characteristics:

- the armature comprises a first portion and a second portion arranged to house said annular body;
- the first portion and the second portion house said annular body in a non-removable manner;
- the electrical conductor comprises a connection portion;
- a connector is disposed substantially axially with respect to said connection portion;
- the first portion of the armature has a recess to accommodate a conductor of the connector and the connection portion of the electrical conductor;
- the first portion is disposed substantially facing the annular body, in which the second portion is disposed substantially facing the electrical conductor, and the thickness of the portion of the second portion which substantially faces the electrical conductor is in the range 25 μm to 300 μm;
- the armature is produced from ceramic material with a bending strength of more than 500 MPa at 20° C., and with an electrical resistivity of more than 1000 ohm.cm for temperatures of less than 400° C.;
- the armature is produced from zirconia;
- it may be provided with a radio frequency identification chip; and
- it may be embedded in a material selected from the group which comprises a hydrogenated nitrile butadiene rubber, a polytetrafluoroethylene, an ethylene-propylene-diene monomer, a fluoroelastomer, a fluorosilicone and a perfluoroalkoxy compound.

The invention also concerns a tubular component for oil operations comprising a half-coupler having one or more of the preceding characteristics, and in which said half-coupler is accommodated in a housing in an end portion of the tubular component.

The invention claimed is:

1. A tubular component for oil exploration, comprising an electromagnetic half-coupler that can be coupled to a half-coupler of another tubular component to allow data transmission;

wherein an end portion of the tubular component comprises a housing accommodating the half-coupler, the half-coupler comprising a coupling element and an annular armature for the coupling element, the coupling element comprising an annular body formed at least in part front a first material with a predetermined magnetic permeability, the coupling element further comprising an electrical conductor having turns, the armature comprising a first portion and a second portion configured to accommodate the coupling element, the armature being at least partially surrounded by isolating and impervious second material to protect the half-coupler against infiltration, wherein the annular body contacts the first portion, the second portion and the second material such that the annular body is enclosed in part by the first portion and the second portion and in part by the second material.

2. The component according to claim 1, wherein the second material is selected from the group of: a hydrogenated rubber enriched with nitrile and butadiene, a polytetrafluoroethylene, an ethylene-propylene-diene monomer, a fluoroelastomer, a fluorosilicone, and a perfluoroalkoxy compound.

3. The tubular component according to claim 1, wherein the second material has elastic and/or damping properties of a spring.

4. The tubular component according to claim 1, wherein the second material comprises a surface substantially facing a bore of the end portion of the tubular component, the surface including annular beads that define a space configured to be at least partially free after assembling the component with another component.

5. The tubular component according to claim 1, further comprising an annular liner accommodated in a bore of the end portion of the tubular component comprising the housing, wherein the housing is defined by an axial abutment surface of the liner.

6. The tubular component according to claim 1, wherein the first portion and the second portion accommodate the annular body.

7. The tubular component according to claim 1, wherein the electrical conductor comprises a connection portion.

8. The tubular component according to claim 7, further comprising a connector disposed substantially axially with respect to the connection portion.

9. The tubular component according to claim 8, wherein the first portion of the armature includes a recess to accommodate a conductor of the connector and the connection portion of the electrical conductor.

10. The tubular component according to claim 1, wherein the first portion is disposed substantially facing the annular body, wherein the second portion is disposed substantially facing the electrical conductor, and wherein a thickness of the portion of the second portion substantially facing the electrical conductor is in a range of 25 μm to 300 μm.

11. The tubular component according to claim 1, wherein the armature is produced from a ceramic material having a bending strength of more than 500 MPa at 20°C. and an electrical resistivity of more than 1000 ohm·cm for temperatures of less than 400° C.

12. The tubular component according to claim 1, wherein the armature is produced from zirconia.

13. The tubular component according to claim 1, wherein the predetermined magnetic permeability is more than 100 in a 1 kHz to 10 MHz range.

14. A threaded tubular connection comprising first and second tubular components according to claim 1, the first tubular component and the second tubular component being mutually assembled by making up their end portions such that the half-coupler of the first tubular component and the half-coupler of the second tubular component are configured to be mutually coupled in operation, an annular space being located axially between the materials of the first tubular component and of the second tubular component after completing makeup.

15. A tubular component for oil exploration, comprising:

an electromagnetic half-coupler that can be coupled to a half-coupler of another tubular component to allow data transmission;

wherein an end portion of the tubular component comprises a housing accommodating the half-coupler, the half-coupler comprising a coupling element and an annular armature for the coupling element, the coupling element comprising an annular body formed at least in part from a first material with a predetermined magnetic permeability, the coupling element further comprising an electrical conductor having turns, the armature comprising a first portion and a second portion configured to accommodate the coupling element, the armature being at least partially surrounded by an isolating and impervious second material to protect the half-coupler against infiltration, wherein a terminal portion of the armature near an outermost portion of the tubular component is thinner than a rest of the armature.

16. The tubular component according to claim 15, wherein the terminal portion of the armature at least partially encloses the electrical conductor.

17. The tubular component according to claim 15, wherein the electrical conductor has an elongate cross-section which is radially oriented proximate to the terminal portion of the armature.

18. The tubular component according to claim 15, wherein a thickness of the terminal portion of the armature ranges from 25 μm to 300 μm.

* * * * *